United States Patent [19]

Cleevely

[11] 4,177,932

[45] Dec. 11, 1979

[54] THERMOPLASTIC CONTAINER FOR STORING AND DISPENSING SOLID PARTICULATE MATERIAL

[75] Inventor: Bruce T. Cleevely, Pittsburgh, Pa.

[73] Assignee: The C. F. Sauer Company, Richmond, Va.

[21] Appl. No.: 18,062

[22] Filed: Mar. 6, 1979

[51] Int. Cl.[2] ..... B65D 39/00

[52] U.S. Cl. ..... 220/307; 220/254; 222/480

[58] Field of Search ..... 220/254, 307; 222/480, 222/556

[56] References Cited

U.S. PATENT DOCUMENTS

| | | | |
|---|---|---|---|
| 3,217,949 | 11/1965 | Davis | 220/254 X |
| 3,596,694 | 8/1971 | Jaeniche | 220/307 X |
| 3,773,232 | 11/1973 | Hidding | 222/480 |
| 4,144,985 | 3/1979 | Kinslow | 220/254 |

*Primary Examiner*—George T. Hall

*Attorney, Agent, or Firm*—Parmelee, Miller, Welsh & Kratz

[57] ABSTRACT

A thermoplastic container for storing and dispensing solid particulate material having a unitary, seamless, thermoplastic body portion, with locking and sealing beads adjacent the open mouth of the body portion which provide for locking of a cap thereon and sealing of the container contents therein.

6 Claims, 5 Drawing Figures

THERMOPLASTIC CONTAINER FOR STORING AND DISPENSING SOLID PARTICULATE MATERIAL

BACKGROUND OF THE INVENTION

Containers for storing and dispensing fine particulate solids, such as spices or other finely divided foodstuffs, are unique in that such containers must be suitable for storage of the goods for long periods of time, and yet enable ready dispersal of the solids therefrom on demand. For example, the normal household may contain cans or containers of spices that, even after a period of shelf life before purchase, may set on the spice shelves or racks of the household for long periods of time before the contents of the container are completely used and repurchase of a new container of spices made.

Because of the extensive storage term for such goods, the containers therefor must provide for sealing of the contents within the container but provide ready access to the contents when use of the same is desired. In order to provide for easy access, such containers have been fitted with caps or covers that, themselves, contain openings such as perforations for sprinkling solids therefrom or larger openings for insertion of a spoon or other transfer container, which perforations or large openings are independently closed, such as by hinged closures.

The conventional body portions of such containers have normally been constructed of sheet metal material and are stamped or otherwise formed therefrom with seams required to seal the container walls and a flange about the inner periphery of the open mouth thereof for locking of the cap thereon. Such caps have previously been formed of thermoplastic material.

Attempts have been made to form a completely thermoplastic container for spices and other such solid particulate material, with both the cap and the body portion of the container formed of thermoplastic, but such have not been commerically accepted. Thermoplastics, such as polypropylene and polyethylene, are excellently suited for such containers since they are impervious to air, do not rust, are lightweight, structurally sound and economically desirable. In the formation of a body portion for such containers from thermoplastic material, however, molding difficulties arise in that the means on the body portion for locking the cap onto the body portion must not interfere with the removal thereof from a mold. Also, upon stripping of such a body portion from the mold, care must be taken so as to not destroy the locking and sealing features of such a body portion for interaction with a cap.

BRIEF SUMMARY OF THE INVENTION

A thermoplastic container for storing finely divided particulate material having a friction fit snap-on cap has a unitary, seamless body portion, the body portion having inwardly extending locking beads adjacent the open mouth thereof along the end and side walls and sealing beads, of a lesser thickness than the locking beads, adjacent the open mouth at the juncture of adjacent end and side walls, such that the body portion may be readily molded and stripped from a mold without damage to the beads and the beads will seal the contents of the container from the atmosphere while locking the friction fit cap thereon through interaction with locking ribs on the flange of the cap.

DETAILED DESCRIPTION

Figure 3:
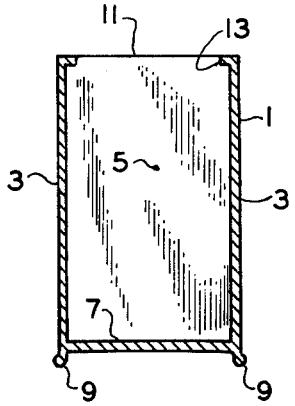
FIG. 3 is a cross sectional view taken along line III—III of FIG. 1.
Figure 1:
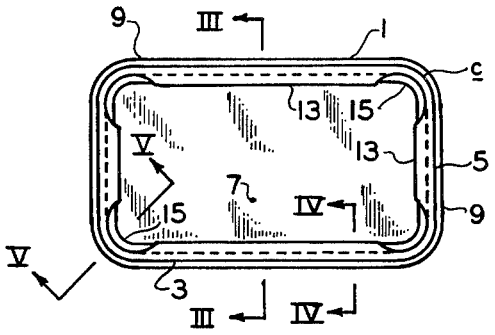
FIG. 1 is a plan view of the body portion of the container of the present invention.
Figure 2:
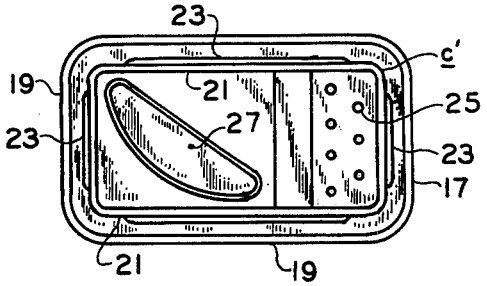
FIG. 2 is a plan view of the underside of the cap of the container of the present invention.

Referring now to FIGS. 1 and 2, there are illustrated the body portion and associated cap of the container of the present invention. As shown, the body portion 1 comprises side walls 3 and end walls 5 which are integral with a common closed bottom 7, the same molded of a thermoplastic material. About the outer periphery of the bottom 7 is an integral rim 9 which reduces the tendency of flat bottomed containers to tip when bumped and provides a secure seating of the container on the surface upon which it may be placed. This rim 9 is sized such that it extends outwardly from the periphery of the walls of the container body portion a distance equal to the distance that the cap outer wall will extend outwardly therefrom, to provide aid during filling and assembly of the containers by spacing the bottoms of adjacent containers an equal distance from the tops of adjacent containers after the cap has been applied. The recess provided by the rim 9 also enables stacking of containers with portions of the lid of a container fitting within said recess.

Adjacent the open mouth 11 of the body portion 1 of the container, and along the side and end walls 3 and 5, there are provided inwardly extending locking beads 13, the purpose of which is explained hereinafter. Also provided adjacent the open mouth 11 are inwardly extending sealing beads 15 which are provided at the juncture c of adjacent side and end walls 3 and 5 of the body portion 1.

A cap 17 for use in closing the open mouth 11 of the body portion is shown in FIG. 2, with the cap illustrated from its underside to best show the locking feature thereof. The cap 17, also of thermoplastic material, has a downwardly extending outer wall 19 about the periphery thereof and a spaced downwardly extending locking flange 21, which locking flange 21 has at the sides and ends thereof locking ribs 23 carried thereon. The ribs 23 are positioned so as to extend between the flange 21 and outer wall 19 of the cap 17. There are no such ribs, however, at the juncture c' of the side and end walls. Since the container is designed for use with solid particulate material, such as ground spices, the cap may have perforations 25 therein for shaking or sprinkling contents from the can and a larger opening 27 for insertion of a spoon or the like or for pouring of larger quantities of contents from the container. These perforations or other openings are, of course, covered by hinged flaps or the like to protect the contents of the container during nonuse. The cap is of conventional design and is not, in itself, novel, but rather the novelty of the container of the present invention lies in the body portion and association thereof with the cap.

Figure 4:
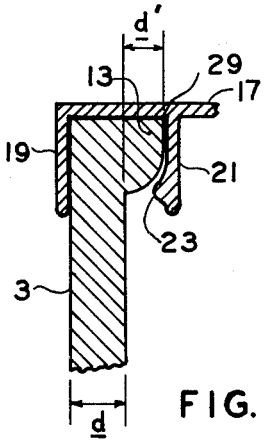
FIG. 4 is an elongated cross sectional segment taken along lines IV—IV of FIG. 1 showing the locking bead and with a segment of the cap shown with the locking feature thereof.
Figure 5:
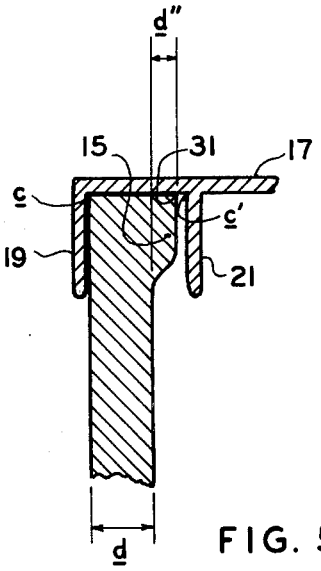
FIG. 5 is an enlarged cross sectional segment taken along lines V—V of FIG. 1 showing the sealing bead and with a segment of the cap shown in association therewith.

Referring now specifically to FIGS. 4 and 5, the specific interaction of the sealing and locking means of the container of the present invention are illustrated. As is shown in FIG. 4, the wall 3, of the body portion, of a thickness designated d, terminates with a relatively sharp outer corner, while the locking bead 13 has a relatively sharp corner 29 at its upper end but is preferably arcuately shaped in the downward direction. The distance between the upper edges 29 and the thickness of the side wall 3, d, is designated as d', and indicates the thickness of the inwardly extending locking bead. In order to lock the cap 17 onto the body portion of the contaner, the sum of the distances d and d', the thickness of the wall and the locking rib is substantially the same as the distance between the downwardly extending outer wall 19 and the spaced downwardly extending locking flange 21 of the cap, with the locking rib 23 and flange 21 being resilient enough so as to flex inwardly and pass over the locking bead 13 and return to normal rest position as illustrated in FIG. 4. Thus, the locking bead 13 prevents lifting of the locking rib 23 and removal of the cap without excessive force. Similar such locking beads 13 are provided on the end walls 5 with association thereof with locking ribs 23 on the end flanges of the cap.

In addition, as shown in FIG. 5, at the juncture c of adjacent end walls 3 and 5 of the body portion, a sealing bead 15 is provided, of a thickness d" which has a relatively sharp edge 31 and is less than the thickness d'. The sum of the distances d and d" is thus less than the distance between the downwardly extending outer wall 19 and the spaced downwardly extending locking flange 21 of the cap. This sealing bead, while not functioning to lock the cap 17 onto the body portion because of its lesser thickness and because the cap does not have locking ribs at the corners, does function to prevent leakage or spillage of the solid content of the container during usage of the container and storage thereof. The sealing bead 15 also terminates in its downward direction in an arcuate construction. The arcuate construction of locking beads 13 and sealing beads 15 permit easy removal of the body portion 1 from forming molds.

As an example of a thermoplastic container of the present invention, the body portion is formed of polypropylene with the bottom 7, side and end walls 3 and 5 and corners having a thickness d of 0.040 inches. The locking beads 13 are of a thickness d' of about 0.025 inches, such that the sum of distances d and d' in FIG. 4 is 0.065 inches. The sealing beads 15, however, are inwardly extending only a thickness d" of 0.016 inches, such that the sume of distances d and d" in FIG. 5 is only 0.056 inches. This minor difference between the thickness of the locking beads 13 and the sealing beads 15 it has been found, enables molding of the body portion and stripping thereof from the mold without damage to the beads, while the same also provides for excellent locking of the cap onto the body portion, as well as sealing of the contents to prevent spillage or deterioration thereof.

I claim:

1. In a thermoplastic container for storing and dispensing solid particulate material, the container comprising a body portion having side and end walls, a closed bottom end and an open mouth, and a friction fit dispensing cap having a downwardly extending outer wall and spaced downwardly extending locking flange carrying locking ribs thereon, the improvement wherein:

said body portion is of unitary, seamless, thermoplastic construction having adjacent the open mouth thereof inwardly extending locking and sealing beads, the locking portion of said beads being along the walls of said body portion and having a thickness sufficient to frictionally lock the cap onto said body portion through contact with the upperside of ribs of said cap, and the sealing portion of said beads being at the juncture of adjacent walls of said body portion and having a thickness less than that of the locking portion of said beads.

2. In the container for storing and dispensing solid particulate material as defined in claim 1, the improvement wherein said locking and sealing portions of said beads are in the form of a continuous bead about the body portion adjacent the mouth thereof.

3. In the container for storing and dispensing solid particulate material as defined in claims 1 or 2 wherein said beads have an upper edge and a downward arcuate shape.

4. In the container for storing and dispensing solid particulate material as defined in claim 1, the improvement comprising a unitary rim about the outer periphery of said closed bottom end.

5. In the container for storing and dispensing solid particulate material as defined in claim 1, the improvement wherein said body portion is of polypropylene.

6. In a thermoplastic container for storing and dispensing solid particulate material, the container comprising a body portion having side and edge walls, a closed bottom end and an open mouth, and a friction fit dispensing cap having a downwardly extending outer wall and spaced downwardly extending locking flange carrying locking ribs thereon, the improvment wherein:

said body portion is of unitary, seamless, thermoplastic construction having a unitary rim about the outer periphery of said closed bottom end, and having adjacent the open mouth thereof a continuous inwardly extending bead having locking and sealing portions, the locking portion of said bead being along the walls of said body portion and having a thickness sufficient to frictionally lock the cap onto said body portion through contact with the upperside of ribs of said cap, and the sealing portion of said bead being at the juncture of adjacent walls of said body portion and having a thickness less than that of the locking portion of said bead.

* * * * *